US007968262B2

(12) United States Patent
Wu

(10) Patent No.: US 7,968,262 B2
(45) **Date of Patent: *Jun. 28, 2011**

(54) BIS(ENYLARYL)ARYLAMINE CONTAINING PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 508 days.

This patent is subject to a terminal disclaimer.

(21) Appl. No.: 12/164,596

(22) Filed: Jun. 30, 2008

(65) Prior Publication Data

US 2009/0325092 A1 Dec. 31, 2009

(51) Int. Cl.
*G03G 5/047* (2006.01)

(52) U.S. Cl. ..... 430/58.8; 430/58.75; 430/58.85; 430/59.4; 430/59.5

(58) Field of Classification Search ..... 430/58.85, 430/58.8, 58.75, 59.4, 59.5
See application file for complete search history.

(56) References Cited

U.S. PATENT DOCUMENTS

| | | | | | |
|---|---|---|---|---|---|
| 4,265,990 | A | | 5/1981 | Stolka et al. | |
| 4,273,846 | A | * | 6/1981 | Pai et al. | 430/58.75 |
| 4,555,463 | A | | 11/1985 | Hor et al. | |
| 4,587,189 | A | | 5/1986 | Hor et al. | |
| 4,606,988 | A | * | 8/1986 | Sasaki | 430/58.75 |
| 4,777,296 | A | * | 10/1988 | Sasaki | 564/433 |
| 5,153,094 | A | | 10/1992 | Kazmaier et al. | |
| 5,166,339 | A | | 11/1992 | Duff et al. | |
| 5,189,155 | A | | 2/1993 | Mayo et al. | |
| 5,189,156 | A | | 2/1993 | Mayo et al. | |
| 5,213,926 | A | * | 5/1993 | Hanatani et al. | 430/58.75 |
| 5,473,064 | A | | 12/1995 | Mayo et al. | |
| 5,482,811 | A | | 1/1996 | Keoshkerian et al. | |
| 5,521,306 | A | | 5/1996 | Burt et al. | |
| 5,567,560 | A | * | 10/1996 | Hagiwara et al. | 430/58.85 |
| 5,882,813 | A | * | 3/1999 | Matsushima et al. | 430/58.45 |
| 6,777,148 | B2 | * | 8/2004 | Kodera et al. | 430/58.65 |
| 6,884,559 | B2 | * | 4/2005 | Yokota | 430/119.6 |
| 2006/0105254 | A1 | * | 5/2006 | Wu et al. | 430/59.5 |
| 2007/0287083 | A1 | | 12/2007 | Gondoh et al. | |
| 2009/0325089 | A1 | | 12/2009 | Wu | |
| 2009/0325090 | A1 | | 12/2009 | Wu et al. | |
| 2009/0325091 | A1 | | 12/2009 | Wu et al. | |
| 2009/0325093 | A1 | | 12/2009 | Wu | |
| 2009/0325096 | A1 | | 12/2009 | Wu | |

FOREIGN PATENT DOCUMENTS

| | | | | |
|---|---|---|---|---|
| EP | 0 984 334 | A2 | | 3/2000 |
| GB | 2 265 022 | | | 9/1993 |
| JP | 11174696 | A | * | 7/1999 |
| JP | 2003043715 | A | * | 2/2003 |
| JP | 2003066636 | A | * | 3/2003 |

OTHER PUBLICATIONS

English language machine translation of JP 11-174696 (Jul. 1999).*
English language machine translation of JP 2003-043715 (Feb. 2003).*
English language machine translation of JP 2003-066636 (Mar. 2003).*
Borsenberger, Paul M. & David S. Weiss. Organic Photoreceptors for Imaging Systems. New York: Macel-Dekker, Inc (1993) pp. 289-296.*
Diamond, Arthur S & David Weiss (eds.) Handbook of Imaging Materials, 2nd ed.. New York: Marcel-Dekker, Inc. (Nov. 2001) pp. 401-403.*
Jin Wu, U.S. Appl. No. 12/112,206, filed Apr. 30, 2008 and entitled Metal Mercaptoimidazoles Containing Photoconductors.
Jin Wu, U.S. Appl. No. 12/059,587, filed Mar. 31, 2008 and entitled Titanocene Containing Photoconductors.
Jin Wu, U.S. Appl. No. 12/059,573, filed Mar. 31, 2008 and entitled Oxadiazole Containing Photoconductors.

* cited by examiner

*Primary Examiner* — Christopher RoDee
(74) *Attorney, Agent, or Firm* — Oliff & Berridge, PLC

(57) ABSTRACT

A photoconductor that includes, for example, a supporting substrate, a photogenerating layer, and a bis(enylaryl)arylamine containing charge transport layer.

23 Claims, No Drawings

BIS(ENYLARYL)ARYLAMINE CONTAINING PHOTOCONDUCTORS

CROSS REFERENCE TO RELATED APPLICATIONS

Copending U.S. application Ser. No. 12/164,338, U.S. Publication No. 20090325090 on Phenolic Resin Hole Blocking Layer Photoconductors, filed Jun. 30, 2008, the disclosure of which is totally incorporated herein by reference.

Copending U.S. application Ser. No. 12/164,408, U.S. Publication No. 20090325091 on Phosphonate Containing Photoconductors, filed Jun. 30, 2008, the disclosure of which is totally incorporated herein by reference.

Copending U.S. application Ser. No. 12/164,457, U.S. Publication No. 20090325089 on Polymer Containing Charge Transport Photoconductors, filed Jun. 30, 2008 the disclosure of which is totally incorporated herein by reference.

Copending U.S. application Ser. No. 12/164,549, U.S. Publication No. 20090325096 on Tris(enylaryl)amine Containing Photoconductors, filed Jun. 30, 2008 , the disclosure of which is totally incorporated herein by reference.

Copending U.S. application Ser. No. 12/164,658, U.S. Publication No. 20090325095 on Tris and Bis(enylaryl)arylamine Mixtures Containing Photoconductors, filed Jun. 30, 2008, the disclosure of which is totally incorporated herein by reference.

Copending U.S. application Ser. No. 12/164,701, U.S. Publication No. 20090325093 on (Enylaryl)bisarylamine Containing Photoconductors, filed Jun. 30, 2008, the disclosure of which is totally incorporated herein by reference.

In copending U.S. application Ser. No. 12/112,206, U.S. Publication 20090274965, filed Apr. 30, 2008 and entitled Metal Mercaptoimidazoles Containing Photoconductors, the disclosure of which is totally incorporated herein by reference, there is illustrated a photoconductor comprising an optional supporting substrate, a photogenerating layer, and at least one charge transport layer wherein at least one of the charge transport layers is comprised of at least one charge transport component, and wherein at least one of the photogenerating layer and the charge transport layer includes a metal mercaptoimidazole.

In U.S. application Ser. No. 12/059,587, now U.S. Pat. No. 7,811,732, filed Mar. 31, 2008 and entitled Titanocene Containing Photoconductors, the disclosure of which is totally incorporated herein by reference, there is illustrated a photoconductor comprising an optional supporting substrate, a photogenerating layer, and at least one charge transport layer wherein at least one of the charge transport layers is comprised of at least one charge transport component, and wherein at least one of the photogenerating layer and the charge transport layer includes a titanocene.

In copending U.S. application Ser. No. 12/059,573, U.S. Publication No. 20090246664, filed Mar. 31, 2008 and entitled Oxadiazole Containing Photoconductors, the disclosure of which is totally incorporated herein by reference, there is illustrated a photoconductor comprising an optional supporting substrate, a photogenerating layer, and at least one charge transport layer wherein at least one of the charge transport layers is comprised of at least one charge transport component, and where at least one of the photogenerating layer and the charge transport layer includes an oxadiazole.

A number of the components and amounts thereof of the above copending applications, such as the supporting substrates, resin binders, photogenerating layer components, antioxidants, charge transport components, hole blocking layer components, adhesive layers, and the like, may be selected for the photoconductors of the present disclosure in embodiments thereof.

BACKGROUND

This disclosure is generally directed to photoreceptors, photoconductors, and the like. More specifically, the present disclosure is directed to rigid, multilayered flexible belt imaging members, or devices comprised of an optional supporting medium like a substrate, at least one of a photogenerating layer and a charge transport layer containing an additive of bis(enylaryl)arylamine, including a plurality of charge transport layers, such as a first charge transport layer and a second charge transport layer, an optional adhesive layer, an optional hole blocking or undercoat layer, and an optional overcoating layer. At least one in embodiments refers, for example, to 1, to from 1 to about 10, to from 2 to about 7; to from 2 to about 4, to 2, and the like. Moreover, the bis(enylaryl)arylamine can be added to at least one of the charge transport layers and, for example, instead of being dissolved in the charge transport layer solution, the bis(enylaryl)arylamine can be added to the charge transport mixture as a dopant.

Yet more specifically, there is disclosed a photoconductor comprised of a supporting substrate, a photogenerating layer, and a bis(enylaryl)arylamine containing charge transport layer or charge transport layers, such as a first pass charge transport layer, a second pass charge transport layer, or both the first and second pass charge transport layers to primarily permit minimum crystallization of the charge transport component, and in embodiments charge transport molecules that are free of crystallization; possess rapid or fast transport of charges; excellent ghosting characteristics; excellent photoconductor photosensitivites and an acceptable, and in embodiments, a low $V_r$; and minimization or prevention of $V_r$ cycle up. Crystallization tends to render the charge transport component, like a number of aryl amine molecules, ineffective, and more specifically, crystallization can cause, subsequent to cycling, unacceptable print quality in, for example, a number of xerographic copying and printing apparatuses.

Also disclosed are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697, and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

In U.S. Pat. No. 5,463,128, there is disclosed a photoconductor with a charge transport layer of a 1,4-bis(4,4-diphenyl-1,3-butadienyl)benzene derivative; reference the formulas and structures beginning at column 3 and continuing to column 8.

Layered photoresponsive imaging members have been described in numerous U.S. patents, such as U.S. Pat. No. 4,265,990, wherein there is illustrated an imaging member comprised of a photogenerating layer, and a hole transport layer.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, where a pigment precursor Type I chlorogallium phthalocyanine is prepared by the reaction of gallium chloride in a solvent, such as N-methylpyrrolidone, present in an amount of from about 10 parts to about 100 parts, with 1,3-diiminoisoindolene ($DI^3$) in an amount of from about 1 part to about 10 parts, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

The appropriate components and processes of the above recited patents may be selected for the present disclosure in embodiments thereof.

SUMMARY

Disclosed in embodiments are imaging members with many of the advantages illustrated herein, such as minimal crystallization of the charge transport compounds; excellent and reduced or low image ghosting characteristics; fast transport; extended lifetimes of service of, for example, in excess of about 1,000,000 imaging cycles; excellent electrical characteristics; stable electrical properties; low background; consistent $V_r$ (residual potential), that is substantially flat or no change over a number of imaging cycles as illustrated by the generation of known PIDC (Photoinduced Discharge Curve), and the like. Also disclosed are layered photoresponsive imaging members which are responsive to visible light and to near infrared radiation of from about 700 to about 900 nanometers.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

EMBODIMENTS

Aspects of the present disclosure relate to an imaging member comprising an optional supporting substrate, a photogenerating layer, and at least one charge transport layer comprised of at least one charge transport component, and where the charge transport layer contains a bis(enylaryl)arylamine additive; a photoconductor comprising a supporting substrate, a photogenerating layer, and at least one charge transport layer; and wherein the charge transport layer contains a bis(butadienylaryl)arylamine; and a photoconductor comprised in sequence of a supporting substrate, a photogenerating layer, and a charge transport layer; and wherein the charge transport layer contains a bis(butadienylaryl)arylamine.

Examples of Charge Transport Layer Additives

Various effective amounts of the bis(enylaryl)arylamine can be added to the charge transport layer such as, for example, from about 0.1 to about 30 weight percent, from about 1 to about 20 weight percent, from about 2 to about 10 weight percent, from about 3 to about 15 weight percent, and from about 1 to about 12 weight percent.

A number of additives can be included in the charge transport layer or charge transport layers, in amounts, for example, that in embodiments may be dependant on the thickness of the charge transport layer or layers, and which amounts are, for example, as illustrated herein. Examples of additives included in the charge transport layer are represented by or encompassed by the following formula/structure

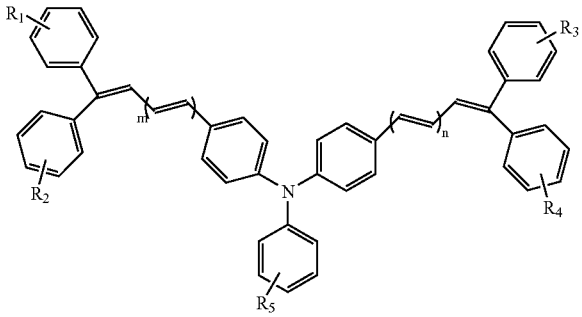

wherein each R is hydrogen, alkyl, alkoxy, aryl, substituted derivatives thereof, halo, and the like; and m and n each represents the number of segments, such as, for example, 0 to about 1.

More specifically, examples of the charge transport layer additives are bis(butadienylaryl)arylamines such as bis[4-(4,4-diphenyl-1,3-butadienyl)phenyl]phenylamine (T-651 available from Takasago Chemical Corp., Tokyo, Japan), and N,N-bis[4-[4,4-bis(4-methylphenyl)-1,3-butadienyl]phenyl]-4-methoxyphenylamine; (ethenylaryl)(butadienylaryl) arylamines such as [4-(2,2-diphenylethenyl)phenyl][4-(4,4-diphenyl-1,3-butadienyl)phenyl]phenylamine; bis (ethenylaryl)arylamines such as N,N-bis[4-(2,2-diphenylethenyl)phenyl]-4-methylphenylamine (T-736 available from Takasago Chemical Corp., Tokyo, Japan), N,N-bis[4-[2,2-bis(4-methylphenyl)ethenyl]phenyl]-4-methylphenylamine (T-925 available from Takasago Chemical Corp., Tokyo, Japan), and the like, and mixtures thereof.

In embodiments, the additive can be represented by the following formulas/structures

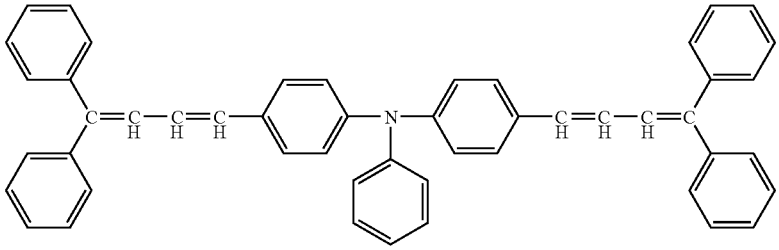

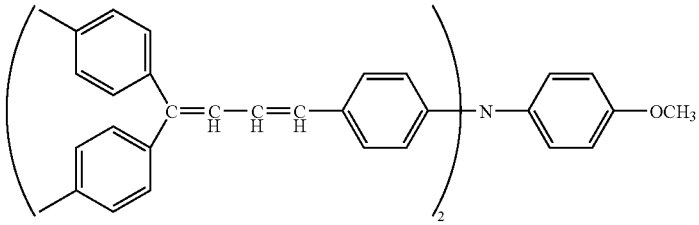

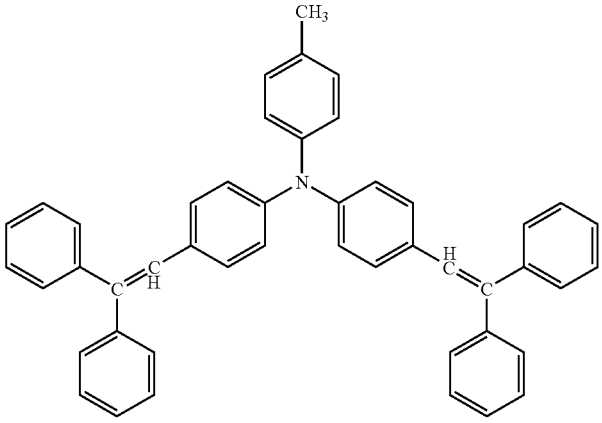

and

-continued

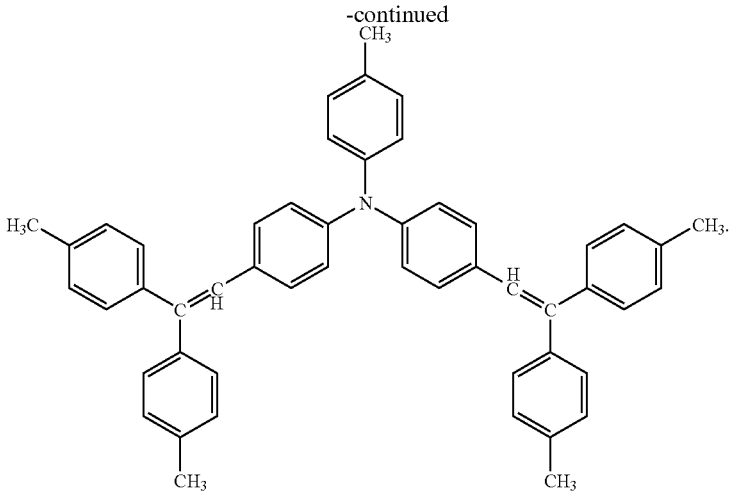

Photoconductor Layers

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

A number of know supporting substrates can be selected for the photoconductors illustrated herein, such as those substrates that will permit the layers thereover to be effective. The thickness of the substrate layer depends on many factors, including economical considerations, electrical characteristics, and the like, thus this layer may be of a substantial thickness, for example over 3,000 microns, such as from about 1,000 to about 3,500, from about 1,000 to about 2,000, from about 300 to about 700 microns, or of a minimum thickness of, for example, about 100 to about 500 microns. In embodiments, the thickness of this layer is from about 75 to about 300 microns, or from about 100 to about 150 microns.

The substrate may be comprised of a number of different materials, such as those that are opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of an optional binder, and known photogenerating pigments, and more specifically, hydroxygallium phthalocyanine, titanyl phthalocyanine, and chlorogallium phthalocyanine, and a resin binder. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly(vinyl butyral), poly(vinyl carbazole), polyesters, polycarbonates, polyarylates, poly(vinyl chloride), polyacrylates and methacrylates, copolymers of vinyl chloride and vinyl acetate, phenolic resins, polyurethanes, poly(vinyl alcohol), polyacrylonitrile, polystyrene, other known suitable binders, and the like. It is desirable to select a coating solvent that does not substantially disturb or adversely affect the previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, dichloroethane, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Group II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

Moreover, the photogenerating layer can be comprised of a photogenerating pigment that is of high value with regard to achieving a number of the advantages illustrated herein, which pigment is a titanyl phthalocyanine component generated, for example, by the processes as illustrated in copending application U.S. application Ser. No. 10/992,500, U.S. Publication No. 20060105254 , the disclosure of which is totally incorporated herein by reference.

A number of titanyl phthalocyanines, or oxytitanium phthalocyanines are suitable photogenerating pigments known to absorb near infrared light around 800 nanometers and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the entire disclosures of which are incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the entire disclosure of which is incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

To obtain a titanyl phthalocyanine based photoreceptor having high sensitivity to near infrared light, it is believed of value to control not only the purity and chemical structure of the pigment, as is generally the situation with organic photoconductors, but also to prepare the pigment in a certain crystal modification. Consequently, it is still desirable to provide a photoconductor where the titanyl phthalocyanine is generated by a process that will provide high sensitivity titanyl phthalocyanines.

In embodiments, the Type V phthalocyanine pigment included in the photogenerating layer can be generated by dissolving Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the resulting Type Y titanyl phthalocyanine with monochlorobenzene.

With further respect to the titanyl phthalocyanines selected for the photogenerating layer, such phthalocyanines exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol and an alkylene halide.

The process illustrated herein further provides a titanyl phthalocyanine having a crystal phase distinguishable from other known titanyl phthalocyanines. The titanyl phthalocyanine Type V prepared by a process according to the present disclosure is distinguishable from, for example, Type IV titanyl phthalocyanines in that a Type V titanyl phthalocyanine exhibits an X-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

In a process embodiment for preparing a high sensitivity phthalocyanine in accordance with the present disclosure, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. An example of a suitable trihaloacetic acid includes, but is not limited to, trifluoroacetic acid. In one embodiment, the solvent for dissolving a Type I titanyl phthalocyanine comprises trifluoroacetic acid and methylene chloride. In embodiments, the trihaloacetic acid is present in an amount of from about one volume part to about 100 volume parts of the solvent, and the alkylene halide is present in an amount of from about one volume part to about 100 volume parts of the solvent. In one embodiment, the solvent comprises methylene chloride and trifluoroacetic acid in a volume-to-volume ratio of about 4 to 1. The Type I titanyl phthalocyanine is dissolved in the solvent by stirring for an effective period of time, such as, for example, for about 30 seconds to about 24 hours, at room temperature. The Type I titanyl phthalocyanine is dissolved by, for example, stirring in the solvent for about one hour at room temperature (about 25° C.). The Type I titanyl phthalocyanine may be dissolved in the solvent in either air or in an inert atmosphere (argon or nitrogen).

Sensitivity is a valuable electrical characteristic of electrophotographic imaging members or photoreceptors. Sensitivity may be described in two aspects. The first aspect of sensitivity is spectral sensitivity, which refers to sensitivity as a function of wavelength. An increase in spectral sensitivity implies an appearance of sensitivity at a wavelength in which previously no or little sensitivity was detected. The second aspect of sensitivity, broadband sensitivity, is a change of sensitivity, for example an increase at a particular wavelength previously exhibiting sensitivity, or a general increase of sensitivity encompassing all wavelengths previously exhibiting sensitivity. This second aspect of sensitivity may also be considered as change of sensitivity, encompassing all wavelengths, with a broadband (white) light exposure. A problem encountered in the manufacturing of photoreceptors is maintaining consistent spectral and broadband sensitivity from batch to batch.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

The photogenerating composition or pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 50 percent by weight of the photogenerating pigment is dispersed in about 80 percent by weight to about 50 percent by weight of the resinous binder composition. In one embodiment, about 50 percent by weight of the photogenerating pigment is dispersed in about 50 percent by weight of the resinous binder composition. The total weight percent of components in the photogenerating layer is about 100.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated photogenerating layer may be effected by any known conventional techniques such as oven drying, infrared radiation drying, air drying, and the like.

The coating of the photogenerating layer in embodiments of the present disclosure can be accomplished to achieve a final dry thickness of the photogenerating layer as illustrated herein, and for example, from about 0.01 to about 30 microns after being dried at, for example, about 40° C. to about 150° C. for about 1 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking, hole blocking layer, or interfacial layer, and the photogenerating layer. Usually, the photogenerating layer is applied onto the blocking layer, and a charge transport layer or plurality of charge transport layers are formed on the photogenerating layer. The photogenerating layer may be applied on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micron (500 Angstroms) to about 0.3 micron (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

The hole blocking or undercoat layer or layers for the photoconductors of the present disclosure can contain a number of components including known hole blocking components, such as amino silanes, doped metal oxides, a metal oxide like titanium, chromium, zinc, tin and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylenediisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound containing, for example, at least two phenolic groups, such as bisphenol S; and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene)bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

Charge transport layer components and molecules include a number of known materials such as those illustrated herein, such as aryl amines, which layer is generally of a thickness of from about 5 to about 75 microns, and more specifically, of a thickness of from about 10 to about 40 microns. Examples of charge transport layer components include

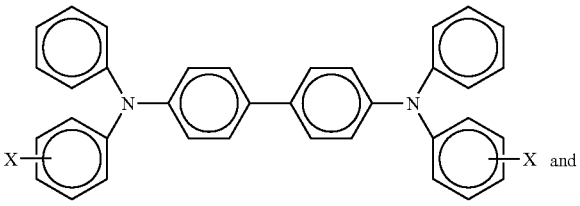

and

-continued

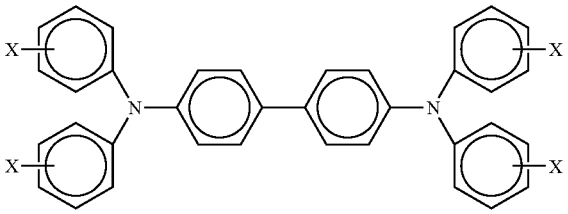

wherein X is alkyl, alkoxy, aryl, a halogen, or mixtures thereof, and especially those substituents selected from the group consisting of Cl, $OCH_3$ and $CH_3$; and molecules of the following formula

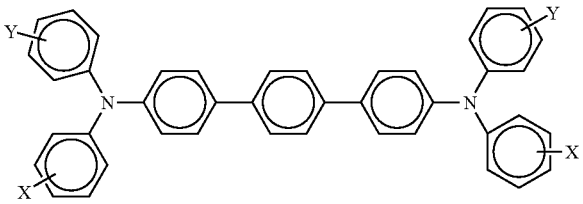

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl -6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, tetra-p-tolyl-biphenyl-4,4'-diamine, N,N-diphenyl-N,N'-bis(4-methoxyphenyl)-1,1-biphenyl-4,4'-diamine, and the like. Other known charge transport layer molecules can be selected, reference for example, U.S. Pat. Nos. 4,921,773 and 4,464,450, the disclosures of which are totally incorporated herein by reference.

In embodiments the charge transport component can be represented by the following formulas/structures

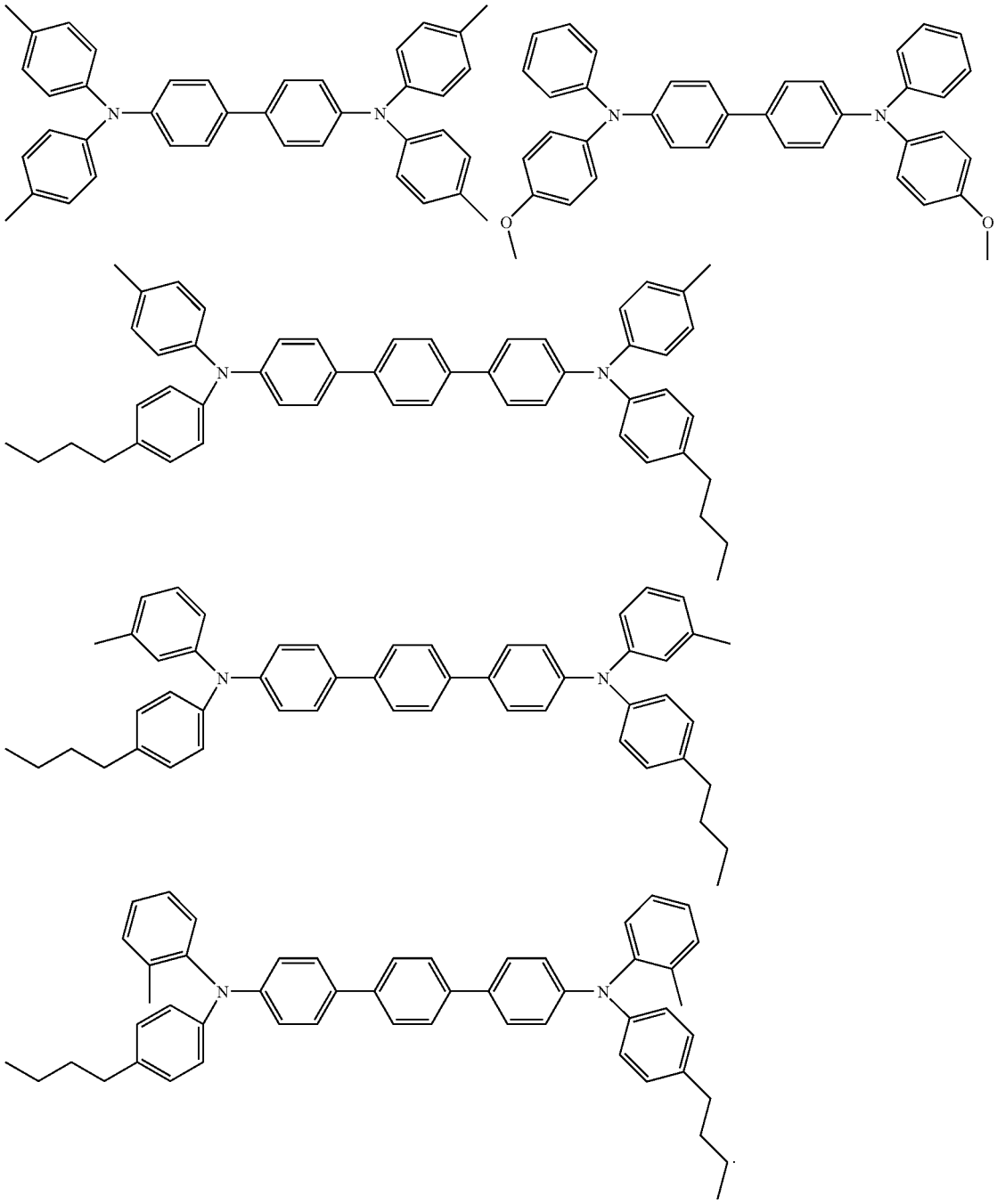

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the charge transport layer binders are comprised of polycarbonate resins with a weight average molecular weight of from about 20,000 to about 100,000, or with a molecular weight $M_w$ of from about 50,000 to about 100,000 preferred. Generally, in embodiments the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl-]4,4'-diamine, N,N'-bis(4-butylphenyl)-N,N'-bis-(4-isopropylphenyl)-[p-terphenyl]-4,4'-diamine, N,N'-bis(4-butylphenyy)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times, and which layer contains a binder and a silanol includes N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material, and a polymeric charge transport material.

The thickness of each of the charge transport layers in embodiments is from about 5 to about 75 microns, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 microns. In embodiments, this thickness for each layer is from about 1 to about 5 microns. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging, and should not have too high a free carrier concentration.

The overcoat can comprise the same components as the charge transport layer wherein the weight ratio between the charge transporting small molecules, and the suitable electrically inactive resin binder is, for example, from about 0/100 to about 60/40, or from about 20/80 to about 40/60.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. At least one refers, for example, to from 1 to about 5, from 1 to about 2, 1, 2, and the like. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. Also, parts and percentages are by weight unless otherwise indicated. All photoconductor devices are prepared on 30 millimeter drum substrates.

EXAMPLE I

Preparation of Type I Titanyl Phthalocyanine:

A Type I titanyl phthalocyanine (TiOPc) was prepared as follows. To a 300 milliliter three-necked flask fitted with mechanical stirrer, condenser and thermometer maintained under an argon atmosphere were added 3.6 grams (0.025 mole) of 1,3-diiminoisoindoline, 9.6 grams (0.075 mole) of o-phthalonitrile, 75 milliliters (80 weight percent) of tetrahydronaphthalene and 7.11 grams (0.025 mole) of titanium tetrapropoxide (all obtained from Aldrich Chemical Company except phthalonitrile which was obtained from BASF). The resulting mixture (20 weight percent of solids) was stirred and warmed to reflux (about 198° C.) for 2 hours. The resultant black suspension was cooled to about 150° C., and then was filtered by suction through a 350 milliliter, M-porosity sintered glass funnel, which had been preheated with boiling dimethyl formamide (DMF). The solid Type I TiOPc product resulting was washed with two 150 milliliter portions of boiling DMF, and the filtrate, initially black, became a light blue-green color. The solid was slurried in the funnel with 150 milliliters of boiling DMF, and the suspension was filtered. The resulting solid was washed in the funnel with 150 milliliters of DMF at 25° C., and then with 50 milliliters of methanol. The resultant shiny purple solid was dried at 70° C. overnight to yield 10.9 grams (76 percent) of pigment, which were identified as Type I TiOPc on the basis of their X-ray powder diffraction trace. Elemental analysis of the product indicated C, 66.54; H, 2.60; N, 20.31; and Ash ($TiO_2$), 13.76. TiOPc requires (theory) C, 66.67; H, 2.80; N, 19.44; and Ash, 13.86.

A Type I titanyl phthalocyanine can also be prepared in 1 chloronaphthalene or N-methyl pyrrolidone as follows. A 250 milliliter three-necked flask fitted with mechanical stirrer, condenser and thermometer maintained under an atmosphere of argon was charged with 1,3-diiminoisoindolene (14.5 grams), titanium tetrabutoxide (8.5 grams), and 75 milliliters of 1-chloronaphthalene (ClNp) or N methyl pyrrolidone. The mixture was stirred and warmed. At 140° C., the mixture turned dark green and began to reflux. At this time, the vapor (which was identified as n-butanol by gas chromatography) was allowed to escape to the atmosphere until the reflux temperature reached 200° C. The reaction was maintained at this temperature for two hours then was cooled to 150° C. The product was filtered through a 150 milliliter M-porosity sintered glass funnel, which was preheated to approximately 150° C. with boiling DMF, and then washed thoroughly with three portions of 150 milliliters of boiling DMF, followed by washing with three portions of 150 milliliters of DMF at room temperature, and then three portions of 50 milliliters of methanol, thus providing 10.3 grams (72 percent yield) of a shiny purple pigment, which were identified as Type I TiOPc by X-ray powder diffraction (XRPD).

EXAMPLE II

Preparation of Type V Titanyl Phthalocyanine:

Fifty grams of TiOPc Type I were dissolved in 300 milliliters of a trifluoroacetic acid/methylene chloride (1/4, volume/volume) mixture for 1 hour in a 500 milliliter Erlenmeyer flask with magnetic stirrer. At the same time, 2,600 milliliters of methanol/methylene chloride (1/1, volume/volume) quenching mixture were cooled with a dry ice bath for 1 hour in a 3,000 milliliter beaker with magnetic stirrer, and the final temperature of the mixture was about −25° C. The resulting TiOPc solution was transferred to a 500 milliliter addition funnel with a pressure-equalization arm, and added into the cold quenching mixture over a period of 30 minutes. The mixture obtained was then allowed to stir for an additional 30 minutes, and subsequently hose vacuum filtered through a 2,000 milliliter Buchner funnel with fibrous glass frit of about 4 to about 8 millimeters in porosity. The pigment resulting was then well mixed with 1,500 milliliters of methanol in the funnel, and vacuum filtered. The pigment was then well mixed with 1,000 milliliters of hot water (>90° C.), and vacuum filtered in the funnel four times. The pigment was then well mixed with 1,500 milliliters of cold water, and vacuum filtered in the funnel. The final water filtrate was measured for conductivity, which was below 10 μS. The resulting wet cake contained approximately 50 weight percent of water. A small portion of the wet cake was dried at 65° C. under vacuum, and a blue pigment was obtained. A representative XRPD of this pigment after quenching with methanol/methylene chloride was identified by XRPD as Type Y titanyl phthalocyanine.

The remaining portion of the wet cake was redispersed in 700 grams of monochlorobenzene (MCB) in a 1,000 milliliter bottle, and rolled for an hour. The dispersion was vacuum filtered through a 2,000 milliliter Buchner funnel with a fibrous glass frit of about 4 to about 8 millimeters in porosity over a period of two hours. The pigment was then well mixed with 1,500 milliliters of methanol and filtered in the funnel twice. The final pigment was vacuum dried at 60° C. to 65° C. for two days. Approximately 45 grams of the pigment were obtained. The XRPD of the resulting pigment after the MCB conversion was designated as a Type V titanyl phthalocyanine. The Type V had an X ray diffraction pattern having characteristic diffraction peaks at a Bragg angle of 2Q ±0.2° at about 9.0°, 9.6°, 24.0°, and 27.2°.

Comparative Example 1

On a 30 millimeter aluminum drum substrate, an undercoat layer was prepared as follows. Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting coating solution was coated on the substrate via a dip coater; the undercoat layer was pre-heated at 59° C. for 13 minutes, humidified at 58° C. (dew point=54° C.) for 17 minutes, and then was dried at 135° C. for 8 minutes. The thickness of the undercoat layer was approximately 1.3 microns.

A photogenerating layer at a thickness of about 0.2 micron comprising titanyl phthalocyanine Type V as prepared in Example II was deposited on the above hole blocking layer or undercoat layer. The photogenerating layer coating dispersion was prepared as follows. Three grams of the Type V pigment were mixed with 2 grams of the polymeric binder (polyvinyl butyral, BM-S, Sekisui Chemicals, Japan), and 45 grams of n-butyl acetate. The mixture was milled in an Attritor mill with about 200 grams of 1 millimeter Hi-Bea borosilicate glass beads for about 3 hours. The dispersion was filtered through a 20 micron Nylon cloth filter, and the solid content of the dispersion was diluted to about 6 weight percent.

Subsequently, a charge transport layer was coated on top of the photogenerating layer from a solution prepared from tetra-p-tolyl-biphenyl-4,4'-diamine, TmTBD (5 grams),

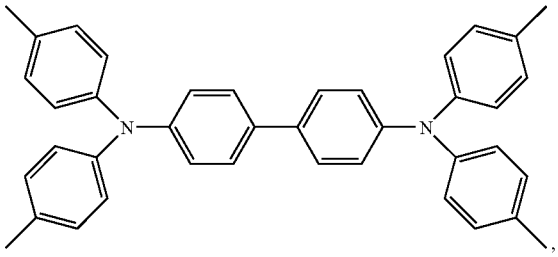

and a film forming polymer binder PCZ-400 [poly(4,4'-dihydroxy-diphenyl-1-1-cyclohexane, $M_w$=40,000)] available from Mitsubishi Gas Chemical Company, Ltd. (7.5 grams) in a solvent mixture of 28 grams of tetrahydrofuran (THF), and 12 grams of toluene via simple mixing. The charge transport layer (PCZ-400/TmTBD =60/40) was dried at about 120° C. for about 40 minutes.

A number of photoconductors were prepared by repeating the above process, with thickness of the charge transport layer being from about 16 microns in Comparative Example 1 (A), to about 20 microns in Comparative Example 1 (B), to about 24 microns in Comparative Example 1 (C), to about 28 microns in Comparative Example 1 (D), and to about 32 microns in Comparative Example 1 (E).

Comparative Example 2

A photoconductive member was prepared by repeating the process of Comparative Example 1 except that there was included in the charge transport layer N,N'-diphenyl-N,N'-bis(3-methylphenyl)-(1,1'-biphenyl)-4,4'-diamine (mTBD) as a replacement for the above TmTBD.

EXAMPLE III

A photoconductive member was prepared by repeating the process of Comparative Example 1 except that there was included in the single tetra-p-tolyl-biphenyl-4,4'-diamine (TmTBD) charge transport layer, 2 weight percent of bis[4-(4,4-diphenyl-1,3-butadienyl)phenyl]phenylamine (T-651 available from Takasago Chemical Corp., Tokyo, Japan), and represented by

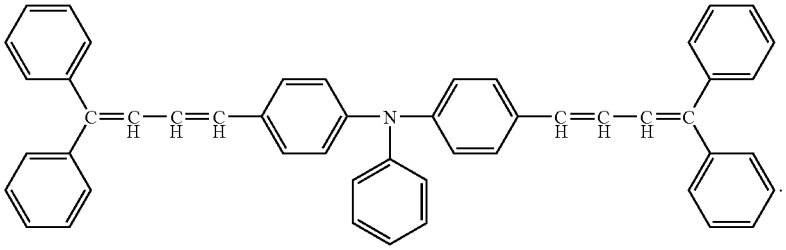

A number of photoconductors were prepared by repeating the above process, resulting in photoconductors each with a charge transport layer (PCZ-400/TmTBD/T-651 ratio of 60/38/2), and from about 16 to about 32 microns in thickness.

EXAMPLE IV

A photoconductive member was prepared by repeating the process of Comparative Example 1 except that there was included in the single tetra-p-tolyl-biphenyl-4,4'-diamine (TmTBD) charge transport layer, 5 weight percent of bis[4-(4,4-diphenyl-1,3-butadienyl)phenyl]phenylamine (T-651 available from Takasago Chemical Corp., Tokyo, Japan), represented by

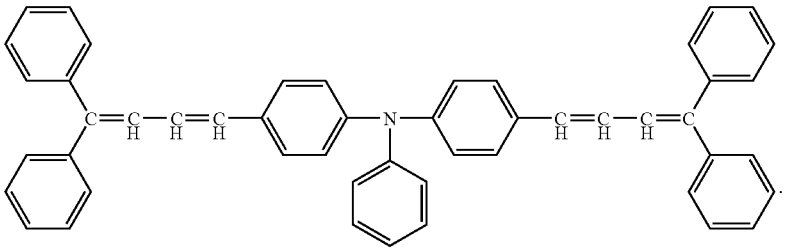

A number of photoconductors were prepared by repeating the above process, resulting in photoconductors each with a charge transport layer (PCZ-400/TmTBD/T-651 ratio 60/35/5), and from about 16 to about 32 microns in thickness.

EXAMPLE V

A photoconductive member was prepared by repeating the process of Comparative Example 1 except that there was included in the single tetra-p-tolyl-biphenyl-4,4'-diamine (TmTBD) charge transport layer, 10 weight percent of bis[4-(4,4-diphenyl-1,3-butadienyl)phenyl]phenylamine (T-651 available from Takasago Chemical Corp., Tokyo, Japan), as represented by

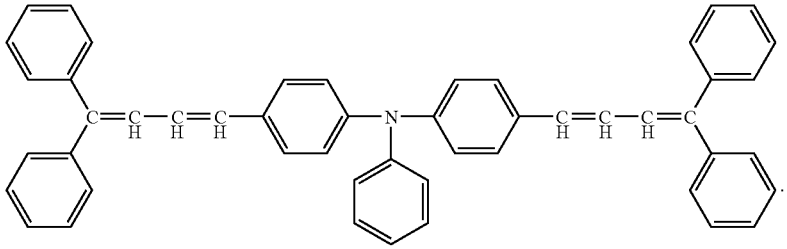

A number of photoconductors was prepared by repeating the above process, resulting in photoconductors each with a charge transport layer (PCZ-400/TmTBD/T-651 ratio of 60/30/10), and from about 16 to about 32 microns in thickness.

EXAMPLE VI

A number of photoconductors are prepared by repeating the process of Comparative Example 1 except that there is included in the single tetra-p-tolyl-biphenyl-4,4'-diamine or TmTBD charge transport layer 10 weight percent of at least one of N,N-bis[4-[4,4-bis(4-methylphenyl)-1,3-butadienyl]phenyl]-4-methoxy phenylamine, [4-(2,2-diphenylethenyl)phenyl][4-(4,4-diphenyl-1,3-butadienyl)phenyl]phenylamine, N,N-bis[4-(2,2-diphenylethenyl)phenyl]-4-methylphenylamine (T-736 available from Takasago Chemical Corp., Tokyo, Japan), and N,N-bis[4-[2,2-bis(4-methylphenyl)ethenyl]phenyl]-4-methylphenylamine (T-925 available from Takasago Chemical Corp., Tokyo, Japan).

Crystallization Measurements

A number of the above prepared photoconductors were visually inspected for charge transport component crystallization, noting that the presence of tetra-p-tolyl-biphenyl-4,4'-diamine (TmTBD) alone may crystallize to form visible crystal domains across the charge transport layer due to its symmetric structure, reference Comparative Example 1. Incorporation of the charge transporting additive, such as disclosed herein, reduces or eliminates in some instances the charge transport component crystallization without adversely affecting the electrical performance of the photoconductors. The crystallization of N,N'-diphenyl-N,N'-bis(3-methylphenyl)-(1,1'-biphenyl)-4,4'-diamine (mTBD) alone is not as severe as TmTBD due primarily to the mTDD less symmetric structure.

Visual inspection for crystallization was rated "YES" or "NO". Whenever any crystal of any size is observed by human eyes, the rating is "YES". Otherwise, the rating is "NO". "NO" rated photoconductor devices were also tested further for their electrical performances.

For the photoconductor of Comparative Example 2 with the mTBD contained in the charge transport layer, substantially no crystallization was visually observed.

As illustrated in Table 1 that follows, the crystallization characteristics for a number of the above prepared photoconductors containing a bis(enylaryl)amine additive in the charge transport layer were excellent, especially for the photoconductors of Example V.

TABLE 1

| TmTBD Crystallization (CTL Thickness) | Comparative Example 1 (TmTBD only) | Example III (TmTBD/T-651 = 38/2) | Example IV (TmTBD/T-651 = 35/5) | Example V (TmTBD/T-651 = 30/10) |
|---|---|---|---|---|
| A (16 μm) | YES | NO | NO | NO |
| B (20 μm) | YES | YES | NO | NO |
| C (24 μm) | YES | YES | NO | NO |
| D (28 μm) | YES | YES | YES | NO |
| E (32 μm) | YES | YES | YES | NO |

Electrical Property Testing

Three of the above prepared photoreceptor devices (with 24 micron thick charge transport layers of Comparative Example 2 and Examples IV (C) and V (C)) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities are measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 700 volts with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.). The results are summarized in Table 2.

TABLE 2

| | V (1 erg/cm$^2$) (V) | V (2 ergs/cm$^2$) (V) | V (4 ergs/cm$^2$) (V) |
|---|---|---|---|
| Comparative Example 2 (mTBD Alone) | 261 | 99 | 80 |
| Example IV (C) (TmTBD/T-651 = 35/5) | 261 | 55 | 28 |
| Example V (C) (TmTBD/T-651 = 30/10) | 260 | 52 | 26 |

There is illustrated by the above Table 2 data a number of improved characteristics, for example, fast transport for the Example IV (C) and V (C) photoconductive members as determined by the generation of known PIDC curves. More specifically, V (1 ergs/cm$^2$), V (2 ergs/cm$^2$), and V (4 ergs/

$cm^2$) in Table 2 each represents the surface potential of the photoconductor when exposure is 1, 2 and 4 ergs/$cm^2$, and is used to characterize the PIDC.

Rapid charge transporting photoconductors were obtained with the TmTBD/T-651 charge transport layers (Examples IV and V) as compared to the mTBD photoconductor (Comparable Example 2). The incorporation of the bis[4-(4,4-diphenyl-1,3-butadienyl)phenyl]phenylamine additive into the charge transport layer minimized or eliminated the TmTBD crystallization.

Rapid or fast transporting refers to fast discharge, for example, 44V lower (2 ergs/$cm^2$) and 54V lower (4 ergs/$cm^2$) for the Example IV (C) and V (C) photoconductive members, as compared to the Comparative Example 2 photoconductive members of 99 and 80, respectively.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a photogenerating layer, a top charge transport layer and a bottom charge transport layer, wherein said top charge transport layer is in contact with said bottom charge transport layer and said bottom charge transport layer is in contact with said photogenerating layer, and wherein there is present in said top charge transport layer, said bottom charge transport layer, or both said top charge transport layer and said bottom change transport layers a mixture of a bis(enylaryl)arylamine selected from the group consisting of bis(butadienylaryl)aryl amine, (ethenylaryl)(butadienylaryl)aryl amine, bis(ethenylaryl)aryl amine, bis[4-(4,4-diphenyl-1,3-butadienyl)phenyl]phenylamine, N,N-bis[4-[4,4-bis(4-methylphenyl)-1,3-butadienyl]phenyl]-4-methoxyphenylamine, [4-(2,2-diphenylethenyl)phenyl][4-(4,4-diphenyl-1,3-butadienyl)phenyl]phenylamine, N,N-bis[4-(2,2-diphenylethenyl)phenyl]-4-methylphenylamine, and N,N-bis[4-[2,2-bis(4-methylphenyl)ethenyl]phenyl]-4-methylphenylamine, and a charge transport component selected from at least one of the group consisting of N,N'-diphenyl-N,N-bis(3-methylphenyl)-1,1'-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-toly-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

2. A photoconductor in accordance with claim 1 wherein said charge transport layer is comprised of said charge transport component, a polymeric binder, and said bis(enylaryl)arylamine.

3. A photoconductor in accordance with claim 1 wherein said bis(enylaryl)arylamine is a bis(butadienylaryl)aryl amine.

4. A photoconductor in accordance with claim 1 wherein said bis(enylaryl)arylamine is a (ethenylaryl)(butadienylaryl)aryl amine.

5. A photoconductor in accordance with claim 1 wherein said bis(enylaryl)arylamine is bis[4-(4,4-diphenyl-1,3-butadienyl)phenyl]phenylamine.

6. A photoconductor in accordance with claim 1 wherein said bis(enylaryl)arylamine is selected from the group consisting of N,N-bis[4-[4,4-bis(4-methylphenyl)-1,3-butadienyl]phenyl]-4-methoxyphenylamine, [4-(2,2-diphenylethenyl)phenyl][4-(4,4-diphenyl-1,3-butadienyl)phenyl] phenyiamine, N,N-bis[4-(2,2-diphenylethenyl)phenyl]-4-methyiphenylamine, and N,N-bis[4-[2,2-bis(4-methylphenyl)ethenyl]phenyl]-4-methylphenylamine, and is present in an amount of from about 1 to about 10 weight percent.

7. A photoconductor in accordance with claim 1 wherein said bis(enylaryl)arylamine is represented by at least one of

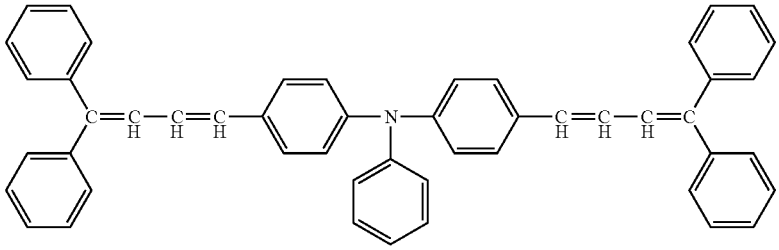

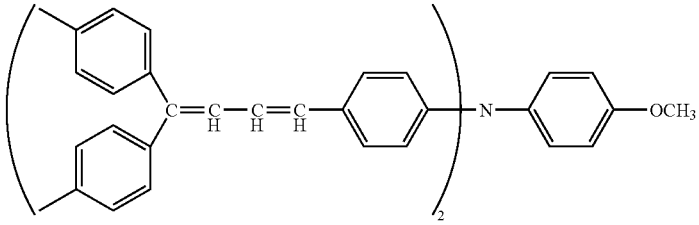

-continued

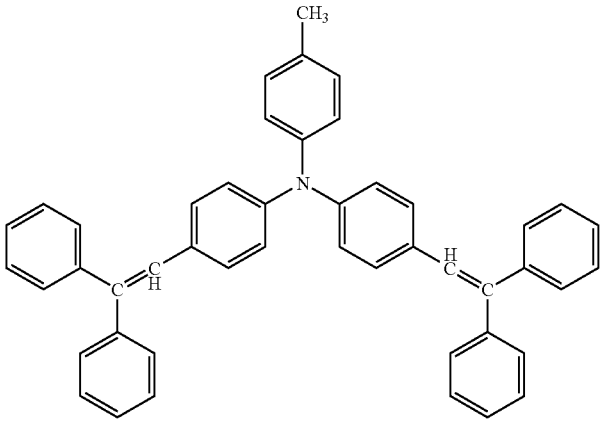

and

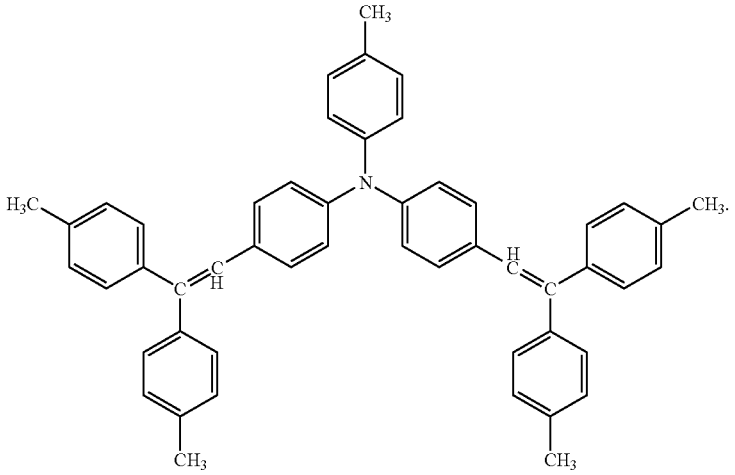

8. A photoconductor in accordance with claim 1 wherein said bis(enylaryl)arylamine is present in an amount of from about 0.1 to about 30 weight percent.

9. A photoconductor in accordance with claim 1 wherein said bis(enylaryl)arylamine is present in an amount of from about 1 to about 20 weight percent.

10. A photoconductor in accordance with claim 1 wherein said bis(enylaryl)arylamine is present in an amount of from about 2 to about 10 weight percent.

11. A photoconductor in accordance with claim 1 wherein said bis(enylaryl)arylamine is present in an amount of from about 1 to about 10 weight percent, and wherein the thickness of said charge transport layer is from about 10 to about 50 microns.

12. A photoconductor in accordance with claim 1 wherein said bis(enylaryl)arylamine is present in an amount of from about 3 to about 15 weight percent, and wherein the thickness of said charge transport layer is from about 20 to about 40 microns.

13. A photoconductor in accordance with claim 1 wherein said charge transport component is selected the group consisting of N,N'-diphenyl-N,N-bis(3-methylphenyl)-1,1'-biphenyl-4,4'-diamine, and tetra-p-tolyl-biphenyl-4,4'-diamine, and said bis(enylaryl)arylamine is a bis (butadienylaryl)aryl amine.)

14. A photoconductor in accordance with claim 1 further including in at least one of said top charge transport layer and bottom charge transport layer an antioxidant comprised of a hindered phenolic, a hindered amine, and mixtures thereof.

15. A photoconductor in accordance with claim 1 wherein said photogenerating layer is comprised of a photogenerating pigment or photogenerating pigments.

16. A photoconductor in accordance with claim 15 wherein said photogenerating pigment is comprised of at least one of a titanyl phthalocyanine, a hydroxygallium phthalocyanine, an alkoxygallium phthalocyanine, a halogallium phthalocyanine, a metal free phthalocyanine, a perylene, and mixtures thereof.

17. A photoconductor in accordance with claim 15 wherein said photogenerating pigment is comprised of a titanyl phthalocyanine Type V.

18. A photoconductor in accordance with claim 1 further including a hole blocking layer, and an adhesive layer, and further containing a supporting substrate.

19. A photoconductor in accordance with claim 1 including a supporting substrate.

20. A photoconductor in accordance with claim 1 wherein said bis(enylaryl)arylamine present in an amount of from about 1 to about 10 weight percent is

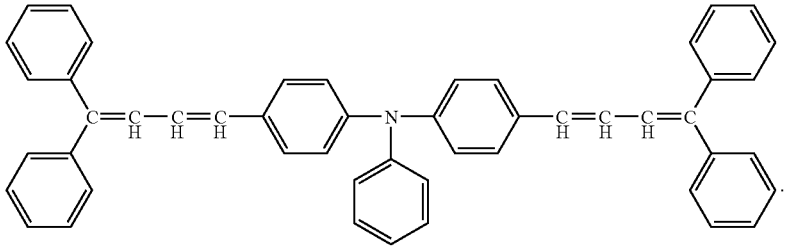

21. A photoconductor comprising a supporting substrate, a photogenerating layer a top charge transport layer and a bottom charge transport layer, wherein said top charge transport layer is in contact with said bottom charge transport layer and said bottom charge transport layer is in contact with said photogenerating layer, and wherein there is present in said top charge transport layer, or said bottom charge transport layer, a mixture of a charge transport component selected from the group consisting N,N'-diphenyl-N,N-bis(3-methylphenyl)-1,1'-biphenyl-4,4'-diamine, tetra-p-tolyl-biphenyl-4,4'-diamine, N,N'-diphenyl-N,N'-bis(4-methoxyphenyl)-1,1 -biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine and a bis(butadienylaryl)arylamine selected from the group consisting of bis(butadienylaryl)aryl amine, (ethenylaryl)(butadienylaryl)aryl amine, bis(ethenylaryl)aryl amine, bis[4-(4,4-diphenyl-1,3-butadienyl)phenyl]phenylamine, N,N-bis[4-[4,4-bis(4-methylphenyl)-1,3-butadienyl]phenyl]-4-methoxyphenylamine, [4-(2,2-diphenylethenyl)phenyl][4-(4,4-diphenyl-1,3-butadienyl)phenyl]phenylamine, N,N-bis[4-(2,2-diphenylethenyl)phenyl]-4-methylphenylamine, and N,N-bis[4-[2,2-bis(4-methylphenyl)ethenyl]phenyl]-4-methylphenylamine.

22. A photoconductor in accordance with claim 21 wherein said bis(butadienylaryl)arylamine is bis[4-(4,4-diphenyl-1,3-butadienyl)phenyl] phenylamine.

23. A photoconductor in accordance with claim 21 wherein said charge transport layer is comprised of N,N'-diphenyl-N,N-bis(3-methylphenyl)-1,1'-biphenyl-4,4'-diamine, tetra-p-tolyl-biphenyl-4,4'-diamine, or N,N'-diphenyl-N,N'-bis(4-methoxyphenyl)-1,1-biphenyl-4,4'-diamine, and wherein said bis(butadienylaryl)arylamine is bis[4-(4,4-diphenyl-1,3-butadienyl)phenyl]phenylamine.

* * * * *